US008720553B2

(12) United States Patent
Tips et al.

(10) Patent No.: US 8,720,553 B2
(45) Date of Patent: May 13, 2014

(54) COMPLETION ASSEMBLY AND METHODS FOR USE THEREOF

(71) Applicant: Halliburton Energy Services, Inc., Houston, TX (US)

(72) Inventors: Timothy R. Tips, Montgomery, TX (US); William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/898,096

(22) Filed: May 20, 2013

(65) Prior Publication Data

US 2014/0083683 A1 Mar. 27, 2014

(51) Int. Cl.
*E21B 43/12* (2006.01)

(52) U.S. Cl.
USPC ..... 166/250.15; 166/250.01; 166/380

(58) Field of Classification Search
USPC ..... 166/380, 250.01, 250.15
See application file for complete search history.

(56) References Cited

U.S. PATENT DOCUMENTS 6,257,332 B1 * 7/2001 Vidrine et al. ..... 166/250.15
7,055,598 B2 6/2006 Ross et al.
7,228,912 B2 * 6/2007 Patel et al. ..... 166/380
7,735,555 B2 * 6/2010 Patel et al. ..... 166/278
7,950,454 B2 * 5/2011 Patel et al. ..... 166/278
2007/0235185 A1 10/2007 Patel et al.
2010/0175894 A1 7/2010 Debard et al.
2011/0209873 A1 9/2011 Stout

FOREIGN PATENT DOCUMENTS

WO 2012112657 8/2012

OTHER PUBLICATIONS

International Search Report and Written Opinion, PCT/US2012/057231, KIPO, Apr. 23, 2013.

* cited by examiner

*Primary Examiner* — Nicole Coy
(74) *Attorney, Agent, or Firm* — Scott Wendorf

(57) ABSTRACT

A completion assembly for operation in a subterranean well having multiple production zones. The completion assembly includes a lower completion assembly operably positionable in the well. The lower completion assembly includes first and second zonal isolation subassemblies. An upper completion assembly is operably positionable at least partially within the lower completion assembly to establish fluid communication between first and second fluid flow control modules, respectively, with the first and second zonal isolation subassemblies. A first communication medium having a connection between the upper and lower completion assemblies extends through the first and second zonal isolation subassemblies. A second communication medium is operably associated with the first and second fluid flow control modules. Data obtained by monitoring fluid from the production zones is carried by the first and second communication media and is used to control production through the first and second fluid flow control modules.

22 Claims, 5 Drawing Sheets

210
208
206
202
204
40
220
200
304
302
300

228
220
106
102
100
300
104
224
226
222
218
216
214
212
40
200
304
302
300
106
104
224
226

COMPLETION ASSEMBLY AND METHODS FOR USE THEREOF

CROSS-REFERENCE TO RELATED APPLICATIONS

This application claims the benefit under 35 U.S.C. §119 of the filing date of International Application No. PCT/US2012/057231, filed Sep. 26, 2012. The entire disclosure of this prior application is incorporated herein by this reference.

TECHNICAL FIELD OF THE INVENTION

This invention relates, in general, to equipment utilized and operations performed in conjunction with a subterranean well and, in particular, to a single trip, multi zone completion assembly having smart well capabilities and methods for use thereof.

BACKGROUND OF THE INVENTION

Without limiting the scope of the present invention, its background is described with reference to providing communication and sensing during a production operation within a subterranean wellbore environment, as an example. It is well known in the subterranean well completion and production arts that downhole sensors can be used to monitor a variety of parameters in the wellbore environment. For example, during production operations, it may be desirable to monitor a variety of downhole parameters such as temperatures, pressures, pH, flowrates and the like in a variety of downhole locations. Transmission of this information to the surface may then allow the operator to modify and optimize the production operations. One way to transmit this information to the surface is using energy conductors such as electrical wires, optical fibers or the like.

In addition or as an alternative to operating as an energy conductor, optical fibers may serve as a sensor. For example, an optical fiber may be used to obtain distributed measurements representing a parameter along the entire length of the fiber. Specifically, optical fibers have been used for distributed downhole temperature sensing, which provides a more complete temperature profile as compared to discrete temperature sensors. In operation, once an optical fiber is installed in the well, a pulse of laser light is sent along the fiber. As the light travels down the fiber, portions of the light are backscattered to the surface due to the optical properties of the fiber. The backscattered light has a slightly shifted frequency such that it provides information that is used to determine the temperature at the point in the fiber where the backscatter originated. As the speed of light is constant, the distance from the surface to the point where the backscatter originated can also be determined. In this manner, continuous monitoring of the backscattered light will provide temperature profile information for the entire length of the fiber.

Use of an optical fiber for distributed downhole temperature sensing may be highly beneficial during production operations. For example, a distributed temperature profile may be used in determining the location of water or gas influx. Likewise, a distributed temperature profile may be used in determining the location of a failed gravel pack. It has been found, however, that installation of a completion including downhole sensors and energy conductors in a multi zone well requires numerous trips into and out of the well. In addition, it has been found, that even after the sensors and energy conductors have been installed and are providing information relative to production, well intervention may be required to modify or optimize the production operations.

Therefore, a need has arisen for an improved completion assembly that is operable to monitor a variety of downhole parameters in a variety of downhole locations. A need has also arisen for such an improved completion assembly that does not require numerous trips into and out of the well for multi zone installations. Further, a need has arisen for such an improved completion assembly that does not require well intervention to modify or optimize the production operations following receipt of information from the downhole sensors.

SUMMARY OF THE INVENTION

The present invention disclosed herein is directed to a single trip, multi zone completion assembly having smart well capabilities and methods for use thereof. The completion assembly of the present invention is operable to monitor a variety of downhole parameters in a variety of downhole locations. In addition, the completion assembly of the present invention does not require numerous trips into and out of the well for multi zone installations. Further, the completion assembly of the present invention does not require well intervention to modify or optimize the production operations following receipt of information from the downhole sensors.

In one aspect, the present invention is directed to a completion assembly for operation in a subterranean well having first and second production zones. The completion assembly includes a lower completion assembly that is operably positionable in the well. The lower completion assembly includes first and second zonal isolation subassemblies. An upper completion assembly is operably positionable at least partially within the lower completion assembly to establish fluid communication between first and second fluid flow control modules of the upper completion assembly, respectively, with the first and second zonal isolation subassemblies. A first communication medium having a connection between the upper and lower completion assemblies extends through the first and second zonal isolation subassemblies. A second communication medium is operably associated with the first and second fluid flow control modules. In operation, production from the first production zone is controlled by operating the first fluid flow control module responsive to data obtained by monitoring at least one fluid parameter of fluid from the first production zone (1) exterior of the first zonal isolation subassembly, (2) between the first zonal isolation subassembly and the first fluid flow control module and (3) interior of the first fluid flow control module. In addition, production from the second production zone is controlled by operating the second fluid flow control module responsive to data obtained by monitoring at least one fluid parameter of fluid from the second production zone (1) exterior of the second zonal isolation subassembly, (2) between the second zonal isolation subassembly and the second fluid flow control module and (3) interior of the second fluid flow control module.

In one embodiment, the first and second zonal isolation subassemblies each include a sand control screen and a production sleeve. In some embodiments, the first and second fluid flow control modules each include a control assembly and a valve assembly. In certain embodiments, the first communication medium may be a distributed temperature sensor. In one embodiment, the upper completion assembly is retrievable from the lower completion assembly. In another embodiments, the upper completion assembly is installed within the well in a single trip. In further embodiments, the lower completion assembly is installed within the well in a single trip.

In one embodiment, the first communication medium carries data obtained from monitoring the at least one fluid parameter of fluid from the first production zone exterior of the first zonal isolation subassembly and data obtained from monitoring the at least one fluid parameter of fluid from the second production zone exterior of the second zonal isolation subassembly. In another embodiment, the second communication medium carries data obtained from monitoring the at least one fluid parameter of fluid from the first production zone between the first zonal isolation subassembly and the first fluid flow control module and data obtained from monitoring the at least one fluid parameter of fluid from the second production zone between the second zonal isolation subassembly and the second fluid flow control module. In a further embodiment, the second communication medium carries data obtained from monitoring the at least one fluid parameter of fluid from the first production zone interior of the first fluid flow control module and data obtained from monitoring the at least one fluid parameter of fluid from the second production zone interior of the second fluid flow control module.

In another aspect, the present invention is directed to a method for completing a subterranean well. The method includes positioning a lower completion assembly in the well, the lower completion assembly including first and second zonal isolation subassemblies with a lower portion of a first communication medium extending therethrough and coupled to a lower connector; engaging the lower completion assembly with an upper completion assembly to establish fluid communication between first and second fluid flow control modules of the upper completion assembly, respectively, with the first and second zonal isolation subassemblies, the upper completion assembly including a second communication medium operably associated with the first and second fluid flow control modules and an upper portion of the first communication medium coupled to an upper connector; and operatively connecting the upper and lower connectors to enable communication between the upper and lower portions of the first communication media.

The method may also include setting a first packer of the upper completion assembly uphole of the lower completion assembly; unlocking an expansion joint of the upper completion assembly uphole of the first packer; setting a second packer of the upper completion assembly uphole of the expansion joint; anchoring the upper completion assembly within the lower completion assembly; engaging seal assemblies of the upper completion assembly with seal bores of the lower completion assembly to isolate the fluid communication between the first fluid flow control module and the first zonal isolation subassembly and to isolate the fluid communication between the second fluid flow control module and the second zonal isolation subassembly; controlling production through the first zonal isolation subassembly by operating an interval control valve of the first fluid flow control module and controlling production through the second zonal isolation subassembly by operating an interval control valve of the second fluid flow control module; monitoring at least one fluid parameter exterior of the first zonal isolation subassembly via the first communication medium, monitoring the at least one fluid parameter between the first zonal isolation subassembly and the first fluid flow control module via the second communication medium and monitoring the at least one fluid parameter interior of the first fluid flow control module via the second communication medium; monitoring the at least one fluid parameter exterior of the second zonal isolation subassembly via the first communication medium, monitoring the at least one fluid parameter between the second zonal isolation subassembly and the second fluid flow control module via the second communication medium and monitoring the at least one fluid parameter interior of the second fluid flow control module via the second communication medium; and/or operating the first communication medium as a distributed temperature sensor.

In another aspect, the present invention is directed to a method of operating a completion assembly during production from a subterranean well. The method includes providing an upper completion assembly having first and second fluid flow control modules positioned in a lower completion assembly having first and second zonal isolation subassemblies that are, respectively, in fluid communication with the first and second fluid flow control modules and first and second production zones; providing a first communication medium having a connection between the upper and lower completion assemblies and extending through the first and second zonal isolation subassemblies; providing a second communication medium operably associated with the first and second fluid flow control modules; controlling production from the first production zone by operating the first fluid flow control module responsive to data obtained by monitoring at least one fluid parameter of fluid from the first production zone (1) exterior of the first zonal isolation subassembly, (2) between the first zonal isolation subassembly and the first fluid flow control module and (3) interior of the first fluid flow control module; and controlling production from the second production zone by operating the second fluid flow control module responsive to data obtained by monitoring at least one fluid parameter of fluid from the second production zone (1) exterior of the second zonal isolation subassembly, (2) between the second zonal isolation subassembly and the second fluid flow control module and (3) interior of the second fluid flow control module.

The method may also include operating a first valve assembly to control production from the first production zone and operating a second valve assembly to control production from the second production zone; operating a first interval control valve to control production from the first production zone and operating a second interval control valve to control production from the second production zone; monitoring the at least one fluid parameter of fluid from the first production zone exterior of the first zonal isolation subassembly and monitoring the at least one fluid parameter of fluid from the second production zone exterior of the second zonal isolation subassembly via the first communication medium; operating the first communication medium as a distributed temperature sensor; monitoring the at least one fluid parameter of fluid from the first production zone between the first zonal isolation subassembly and the first fluid flow control module and monitoring the at least one fluid parameter of fluid from the second production zone between the second zonal isolation subassembly and the second fluid flow control module via the second communication medium; and/or monitoring the at least one fluid parameter of fluid from the first production zone interior of the first fluid flow control module and monitoring the at least one fluid parameter of fluid from the second production zone interior of the second fluid flow control module via the second communication medium.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
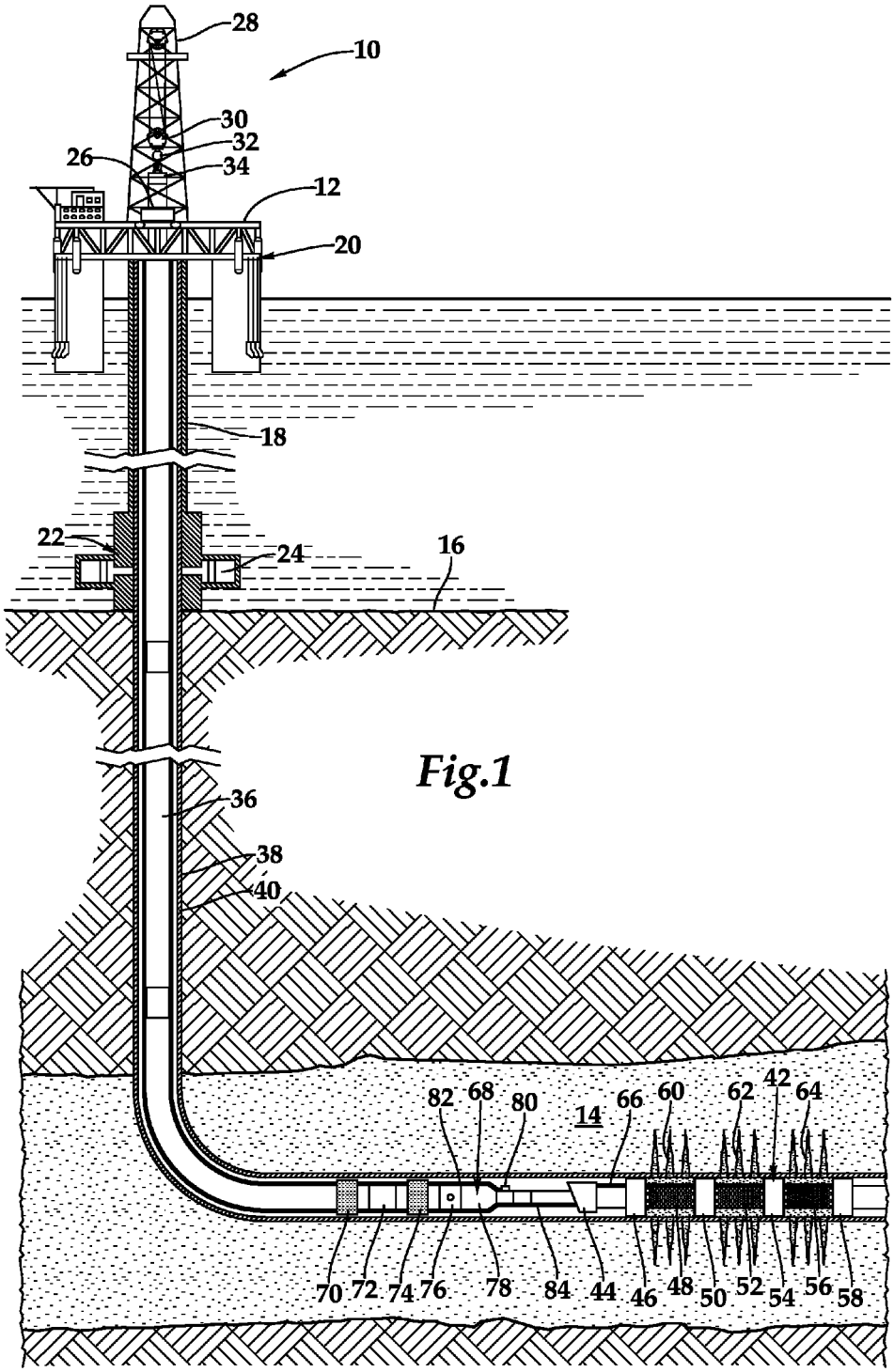
FIG. 1 is a schematic illustration of an offshore oil and gas platform installing an upper completion assembly into a well having a lower completion assembly disposed therein according to an embodiment of the present invention.

Referring initially to FIG. 1, an upper completion assembly is being installed in a well having a lower completion assembly disposed therein from an offshore oil or gas platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending tubing string 36.

A wellbore 38 extends through the various earth strata including formation 14 and has a casing string 40 cemented therein. Disposed in a substantially horizontal portion of wellbore 38 is a lower completion assembly 42 that includes various tools such as an orientation and alignment subassembly 44 including a downhole wet mate connector, packer 46, sand control screen assembly 48, packer 50, sand control screen assembly 52, packer 54, sand control screen assembly 56 and packer 58. As described below, packer 46, sand control screen assembly 48 and packer 50 may be referred to as a zonal isolation subassembly associated with zone 60. Likewise, packer 50, sand control screen assembly 52 and packer 54 may be referred to as a zonal isolation subassembly associated with zone 62 and packer 54, sand control screen assembly 56 and packer 58 may be referred to as a zonal isolation subassembly associated with zone 64. Extending downhole from orientation and alignment subassembly 44 are one or more energy conductors 66 that pass through packers 46, 50, 54 and are operably associated with sensors position on sand control screen assemblies 48, 52, 56 or within the gravel packs surrounding sand control screen assemblies 48, 52, 56. Energy conductors 66 may be optical, electrical, hydraulic or the like and may be disposed within a flatpack control umbilical having, for example, one or more hydraulic conductor lines, one or more electrical conductor lines and one or more fiber optic conductor lines that is suitably attached to the exterior of lower completion assembly 42. Energy conductors 66 may operate as communication media to transmit power, data and the like between the downhole sensors, downhole components and surface equipment. In certain embodiments, one or more of the energy conductors 66 may operate as a downhole sensor.

For example, if optical fibers are used as one or more of the energy conductors 66, the optical fibers may be used to obtain distributed measurements representing a parameter along the entire length of the fiber such as distributed temperature or pressure sensing. In this embodiment, a pulse of laser light from the surface is sent along the fiber and portions of the light are backscattered to the surface due to the optical properties of the fiber. The slightly shifted frequency of the backscattered light provides information that is used to determine the temperature or pressure at the point in the fiber where the backscatter originated. In addition, as the speed of light is constant, the distance from the surface to the point where the backscatter originated can also be determined. In this manner, continuous monitoring of the backscattered light will provide temperature or pressure profile information for the entire length of the fiber.

Disposed in wellbore 38 at the lower end of tubing string 36 is an upper completion assembly 68 that includes various tools such as packer 70, expansion joint 72, packer 74, fluid flow control module 76 and anchor assembly 78 including downhole wet mate connector 80. Extending uphole of connector 80 are one or more energy conductors 82 that pass through packers 70, 74 and extend to the surface in the annulus between tubing string 36 and wellbore 38. Energy conductors 82 are preferably disposed within a flatpack control umbilical as described above that is suitable coupled to tubing string 36. Energy conductors 82 may be optical, electrical, hydraulic or the like and are preferably of the same type as energy conductors 66 such that energy may be transmitted therebetween following a wet mate connection process between energy conductors 82 and energy conductors 66. Upper completion assembly 68 also includes one or more energy conductors 84 that pass through packers 70, 74 and extend to the surface in the annulus between tubing string 36 and wellbore 38. Energy conductors 84 are preferably disposed within a flatpack control umbilical that is suitable coupled to tubing string 36. Energy conductors 84 may be optical, electrical, hydraulic or the like and may operate as communication media to transmit power, data and the like between sensors associated with upper completion assembly 68, downhole components of upper completion assembly 68 and surface equipment. In certain embodiments, one or more of the energy conductors 84 may operate as a downhole sensor such as a distributed temperature or pressure sensor.

Even though FIG. 1 depicts a horizontal wellbore, it should be understood by those skilled in the art that the apparatus according to the present invention is equally well suited for use in wellbores having other orientations including vertical wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present invention is equally well suited for use in onshore operations. Further, even though FIG. 1 depicts a cased hole completion, it should be understood by those skilled in the art that the apparatus according to the present invention is equally well suited for use in open hole completions.

Figure 2A:
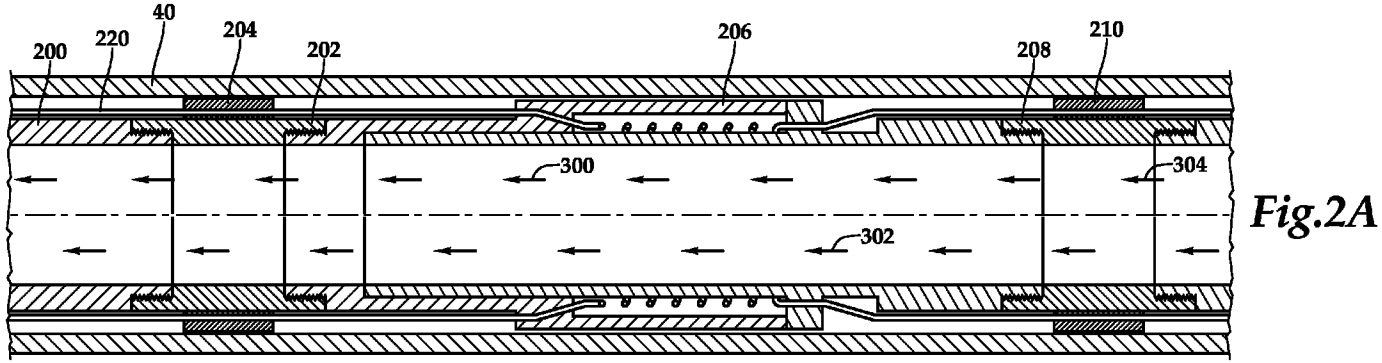
FIGS. 2A-2H are cross sectional views of consecutive axial sections of a single trip, multi zone completion assembly including an upper completion assembly installed within a lower completion assembly during a production operation according to an embodiment of the present invention.
Figure 2B:
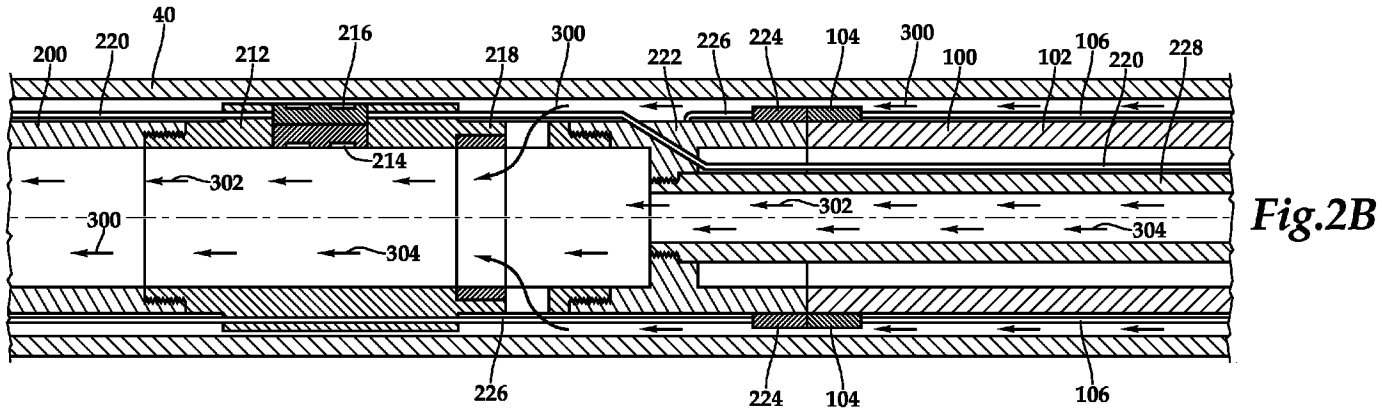

Referring now to FIGS. 2A-2H, therein is schematically depicted successive axial sections of the completion assembly of the present invention including a lower completion assembly 100 and an upper completion assembly 200. As described above, prior to installing upper completion assembly 200, lower completion assembly 100 is positioned in the well. In the illustrated embodiment, the well includes casing 40 that has been perforated in three zones 60, 62, 64. Lower completion assembly 100 will now be described from its uphole end to its downhole end. As best seen in FIG. 2B, lower completion assembly 100 includes an orientation and alignment subassembly 102 that is operable to receive and rotationally align upper completion assembly 200 within lower completion assembly 100. Orientation and alignment subassembly 102 includes one or more downhole wet mate connectors 104 that are operable to connect the various energy conductors disposed within a plurality of flatpack control umbilicals 106 (two shown) with a mating connector of upper completion assembly 200. Umbilicals 106 preferably contained energy conductors such as one or more hydraulic conductor lines, one or more electrical conductor lines and one or more fiber optic conductor lines. Umbilicals 106 are suitably attached to the exterior of lower completion assembly 100.

Figure 2C:
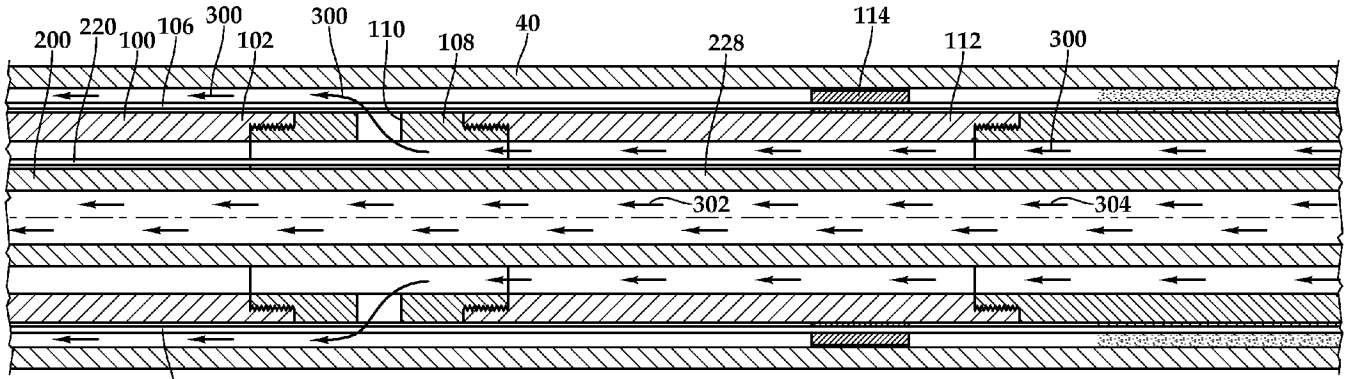
Figure 2D:
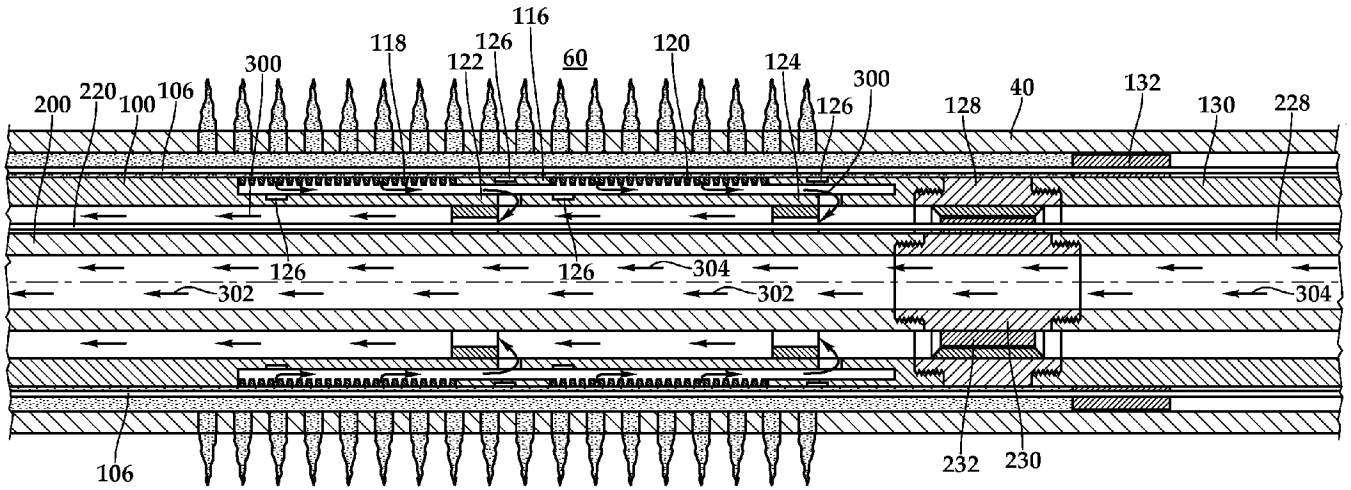

As best seen in FIG. 2C, downhole of orientation and alignment subassembly 102, lower completion assembly 100 includes a ported subassembly 108 having one or more fluid ports 110 for allowing fluid communication between the interior and the exterior of lower completion assembly 100. Lower completion assembly 100 includes a packer assembly 112 having one or more elements 114 for establishing a sealing and gripping relationship with casing 40. As best seen in FIG. 2D, downhole of packer assembly 112, lower completion assembly 100 includes a sand control screen assembly 116. In the illustrated embodiment, sand control screen assembly 116 includes two filter media 118, 120, a production sleeve 122 and a frac sleeve 124. Production sleeve 122 and frac sleeve 124 may be operated mechanically, electrically, hydraulically or the like via local or remote operations to selectively allow or disallow fluid flow therethrough. Also, as illustrated, sand control screen assembly 116 has a plurality of sensors 126 that are operably associated with one or more of the energy conductors of umbilicals 106. Sensors 126 may be of any suitable type for obtaining downhole information such as temperature, pressure, pH, flowrate or the like. Downhole of sand control screen assembly 116, lower completion assembly 100 includes a seal bore subassembly 128 operable to provide an internal sealing surface. Downhole of seal bore subassembly 128, lower completion assembly 100 includes a packer assembly 130 having one or more elements 132 for establishing a sealing and gripping relationship with casing 40. Together, packer assembly 112, sand control screen assembly 116 and packer assembly 130 may be referred to as a zonal isolation subassembly that is associated with zone 60, which is depicted as being gravel packed.

Figure 2E:
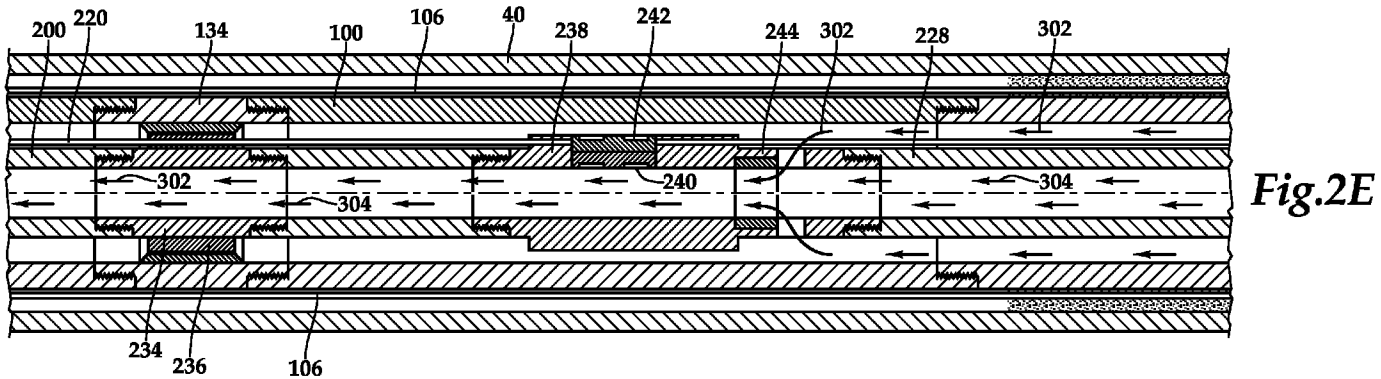
Figure 2F:
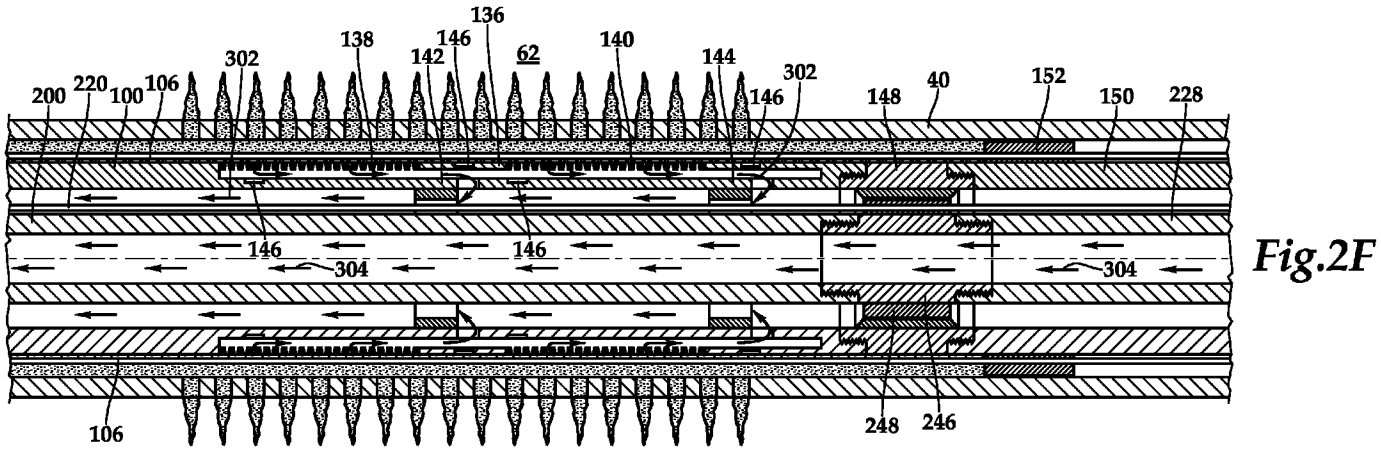

As best seen in FIG. 2E, lower completion assembly 100 includes a seal bore subassembly 134 operable to provide an internal sealing surface. As best seen in FIG. 2F, downhole of seal bore subassembly 134, lower completion assembly 100 includes a sand control screen assembly 136. In the illustrated embodiment, sand control screen assembly 136 includes two filter media 138, 140, a production sleeve 142 and a frac sleeve 144. Production sleeve 142 and frac sleeve 144 may be operated mechanically, electrically, hydraulically or the like via local or remote operations to selectively allow or disallow fluid flow therethrough. Also, as illustrated, sand control screen assembly 136 has a plurality of sensors 146 that are operably associated with one or more of the energy conductors of umbilicals 106. Downhole of sand control screen assembly 136, lower completion assembly 100 includes a seal bore subassembly 148 operable to provide an internal sealing surface. Downhole of seal bore subassembly 148, lower completion assembly 100 includes a packer assembly 150 having one or more elements 152 for establishing a sealing and gripping relationship with casing 40. Together, packer assembly 130, sand control screen assembly 136 and packer assembly 150 may be referred to as a zonal isolation subassembly that is associated with zone 62, which is depicted as being gravel packed.

Figure 2G:
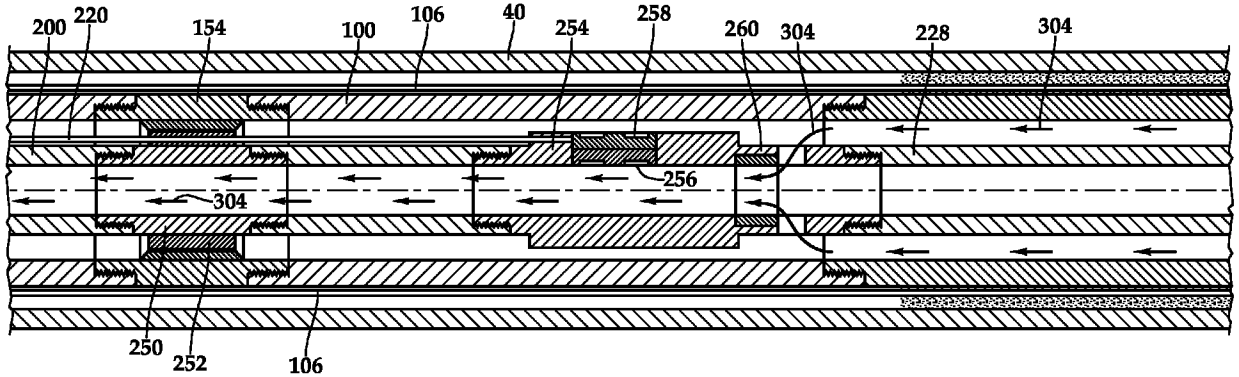
Figure 2H:
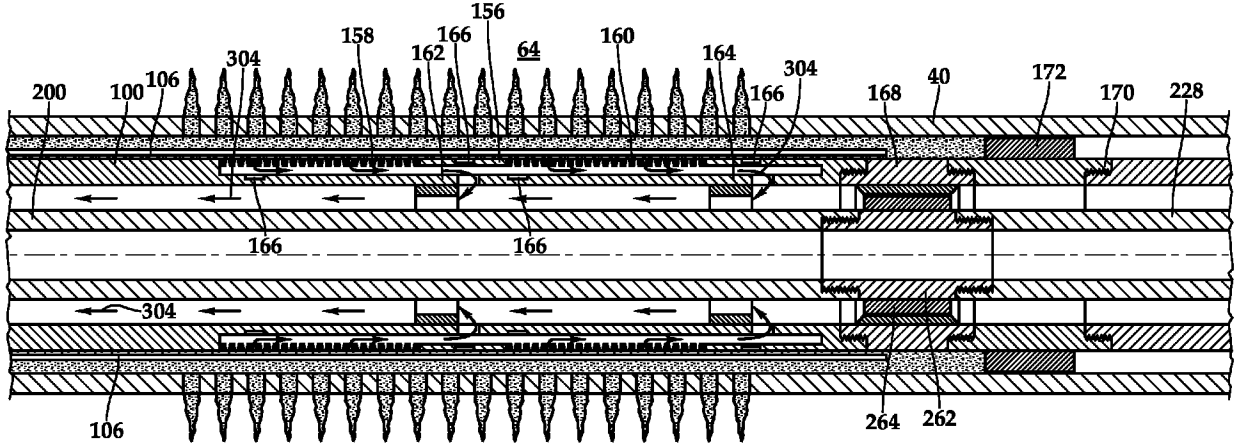

As best seen in FIG. 2G, lower completion assembly 100 includes a seal bore subassembly 154 operable to provide an internal sealing surface. As best seen in FIG. 2H, downhole of seal bore subassembly 154, lower completion assembly 100 includes a sand control screen assembly 156. In the illustrated embodiment, sand control screen assembly 156 includes two filter media 158, 160, a production sleeve 162 and a frac sleeve 164. Production sleeve 162 and frac sleeve 164 may be operated mechanically, electrically, hydraulically or the like via local or remote operations to selectively allow or disallow fluid flow therethrough. Also, as illustrated, sand control screen assembly 156 has a plurality of sensors 166 that are operably associated with one or more of the energy conductors of umbilicals 106. Downhole of sand control screen assembly 156, lower completion assembly 100 includes a seal bore subassembly 168 operable to provide an internal sealing surface. Downhole of seal bore subassembly 168, lower completion assembly 100 includes a packer assembly 170 having one or more elements 172 for establishing a sealing and gripping relationship with casing 40. Together, packer assembly 150, sand control screen assembly 156 and packer assembly 170 may be referred to as a zonal isolation subassembly that is associated with zone 64, which is depicted as being gravel packed.

Upper completion assembly 200 will now be described from its uphole end to its downhole end. As best seen in FIG. 2A, upper completion assembly 200 includes a packer assembly 202 having one or more elements 204 for establishing a sealing and gripping relationship with casing 40. Downhole of packer assembly 202, upper completion assembly 200 includes an expansion joint 206, depicted in its fully contracted configuration, that is operable to extend or contract the length of upper completion assembly 200 as described below. Downhole of expansion joint 206, upper completion assembly 200 includes a packer assembly 208 having one or more elements 210 for establishing a sealing and gripping relationship with casing 40. As best seen in FIG. 2B, upper completion assembly 200 includes a fluid flow control module 212. In the illustrated embodiment, fluid flow control module 212 may be a SCRAMS module from Halliburton that provides for surface controlled reservoir analysis and management in a fully integrated control and data acquisition system. Fluid flow control module 212 includes a plurality of internal sensors 214 and a plurality of external sensors 216 to provide, for example, real-time pressure and temperature data. In addition, fluid flow control module 212 includes an infinitely variable interval control valve 218 which is preferably actuated by hydraulic power routed to an interval control valve piston via solenoid valves (not pictured). Power and communication are provided to fluid flow control module 212 by energy conductors extending from the surface and disposed within a flatpack control umbilical 220 containing, for example, one or more hydraulic conductor lines, one or more electrical conductor lines and one or more fiber optic conductor lines.

Upper completion assembly 200 includes an anchor assembly 222 that is operable to be received in and oriented by orientation and alignment subassembly 102 of lower completion assembly 100. Anchor assembly 222 includes wet mate connectors 224 that are operable to connect the various energy conductors disposed within a plurality of flatpack control umbilicals 226 (two shown) with wet mate connectors 104 of lower completion assembly 100. Umbilicals 226 are suitably attached to the exterior of upper completion assembly 200. Upper completion assembly 200 has a tubing string 228 that extends into lower completion assembly 100. Umbilical 220 also extends into lower completion assembly 100 and is suitably attached to the exterior of tubing string 228. As best seen in FIG. 2D, tubing string 228 includes a seal assembly 230 having one or more elements 232 for establishing a sealing relationship with the internal sealing surface of seal bore subassembly 128. As best seen in FIG. 2E, tubing string 228 also includes a seal assembly 234 having one or more elements 236 for establishing a sealing relationship with the internal sealing surface of seal bore subassembly 134. Downhole thereof, tubing string 228 includes a fluid flow control module 238 such as the SCRAMS module from Halliburton as described above. Fluid flow control module 238 includes a plurality of internal sensors 240 and a plurality of external sensors 242 to provide, for example, real-time pressure and temperature data. In addition, fluid flow control module 238 includes an infinitely variable interval control valve 244. Power and communication are provided to fluid flow control module 238 by energy conductors extending from the surface and disposed within flatpack control umbilical 220.

As best seen in FIG. 2F, tubing string 228 includes a seal assembly 246 having one or more elements 248 for establishing a sealing relationship with the internal sealing surface of seal bore subassembly 148. As best seen in FIG. 2G, tubing string 228 also includes a seal assembly 250 having one or more elements 252 for establishing a sealing relationship with the internal sealing surface of seal bore subassembly 154. Further downhole, tubing string 228 includes a fluid flow control module 254 such as the SCRAMS module from Halliburton as described above. Fluid flow control module 254 includes a plurality of internal sensors 256 and a plurality of external sensors 258 to provide, for example, real-time pressure and temperature data. In addition, fluid flow control module 254 includes an infinitely variable interval control valve 260. Power and communication are provided to fluid flow control module 254 by energy conductors extending from the surface and disposed within flatpack control umbilical 220. As best seen in FIG. 2H, tubing string 228 includes a seal assembly 262 having one or more elements 264 for establishing a sealing relationship with the internal sealing surface of seal bore subassembly 168.

As illustrated, packer assembly 208 between upper completion assembly 200 and casing 40, packer assembly 112 between lower completion assembly 100 and casing 40, and seal assembly 230 between tubing string 228 and lower completion assembly 100 provide an isolated fluid path between sand control screen assembly 116 and fluid flow control module 212. Likewise, seal assembly 234 and seal assembly 246 between tubing string 228 and lower completion assembly 100 provide an isolated fluid path between sand control screen assembly 136 and fluid flow control module 238. Also, seal assembly 250 and seal assembly 262 between tubing string 228 and lower completion assembly 100 provide an isolated fluid path between sand control screen assembly 156 and fluid flow control module 254. In this configuration, production represented by arrows 300 from zone 60 is controlled by fluid flow control module 212, production from zone 62 represented by arrows 302 is controlled by fluid flow control module 238 and production from zone 64 represented by arrows 304 is controlled by fluid flow control module 254.

The operation of installing upper completion assembly 200 into lower completion assembly 100 will now be described. After lower completion assembly 100 has been deployed in the well, preferably in a single trip, each of the zones 60, 62, 64 may be sequentially gravel packed. After removal of the gravel pack service tools, lower completion assembly 100 is ready to receive upper completion assembly 200, which is lowered downhole as a single unit on the end of a tubular string as depicted in FIG. 1. Preferably, expansion joint 206 is locked in its fully extended configuration during this portion of the installation operation. The lower end of tubing string 228 now enters lower completion assembly 100 as upper completion assembly 200 is lowered into lower completion assembly 100 until anchor assembly 222 engages orientation and alignment subassembly 102. At this point, seal assemblies 230, 234, 246, 250, 262 should be aligned with seal bore assemblies 128, 134, 148, 154, 168, respectively. In this configuration, seal assembly 234 and seal assembly 246 provide an isolated fluid path between sand control screen assembly 136 and fluid flow control module 238. Likewise, seal assembly 250 and seal assembly 262 provide an isolated fluid path between sand control screen assembly 156 and fluid flow control module 254.

Anchor assembly 222 is now anchored or locked within orientation and alignment subassembly 102 and wet mate connectors 224 of upper completion assembly 200 are coupled to wet mate connectors 104 of lower completion assembly 100 to establish communication between respective energy conductors in umbilicals 226 of upper completion assembly 200 and umbilicals 106 of lower completion assembly 100. Preferably, the connection of wet mate connectors 224 with wet mate connectors 104 proceeds at a controlled speed in accordance with the teachings of U.S. Pat. No. 8,122,967, the entire contents of which is hereby incorporated by reference. In some embodiments, the connection of wet mate connectors 224 with wet mate connectors 104 may be via inductive coupling. Once the wet mate connections are made and communication via the energy conductors therein is tested and confirmed, packer assembly 208 of upper completion assembly 200 is set to establish a sealing and gripping relationship with casing 40. In this configuration, packer assembly 208, packer assembly 112 and seal assembly 230 provide an isolated fluid path between sand control screen assembly 116 and fluid flow control module 212.

Once packer assembly 208 is set, expansion joint 206 may be unlocked to allow for telescoping of expansion joint 206. This feature enables improved space out operations and setting of the wellhead without placing stress on the completion assembly. Once the wellhead is landed, packer assembly 202 of upper completion assembly 200 is set to establish a sealing and gripping relationship with casing 40. Setting this additional packer assembly 202 above expansion joint 206 provides a redundant seal. In the case of a non sealing expansion joint 206, packer assembly 202 seals off the annulus to prevent tubing fluid from comingling with annulus production and to prevent fluid from migrating up the annulus. In the case of a sealing expansion joint 206, packer assembly 202 isolates the tubing string from expansion and compression forces exerted by expansion joint 206. In some embodiments, expansion joint 206 my be omitted in which case, a logging tool may be used to located the wellhead relative to the landing anchor.

Production operations using the completion assembly of the present invention will now be described. As described above, once upper completion assembly 200 is installed in lower completion assembly 100, production from zone 60 is controlled by fluid flow control module 212, production from zone 62 is controlled by fluid flow control module 238 and production from zone 64 is controlled by fluid flow control module 254. Specifically, this is achieved by monitoring various fluid parameters, such as temperature and pressure at multiple locations associated with production from each zone. For example, sensors 126 are used to obtain fluid parameter data from exterior and the interior of sand control screen assembly 116. Alternatively or additionally, distributed fluid parameter data may be obtained via one or more of the energy conductors, such as an optic fiber, located in the gravel pack to the exterior of sand control screen assembly 116. In either case, the data is transmitted to a surface processor for reporting and analysis via energy conductor in umbilicals 106 of lower completion assembly 100 and umbilicals 226 of upper completion assembly 200. At the same time, additional fluid parameter data may be obtained by sensors 216 in the annulus between upper completion assembly 100 and casing 40 and by sensors 214 to the interior of upper completion assembly 100. This data is transmitted to a surface processor for reporting and analysis via energy conductors in umbilical 220 of upper completion assembly 200. The fluid parameter data associated with production from zone 60 is used to control production from zone 60 by making desired adjustments to the position of infinitely variable interval control valve 218. For example, monitoring pressures to the exterior of sand control screen assembly 116 via certain sensors 126 as well as to the interior of sand control screen assembly 116 via other sensors 126 or via sensors 214, 216, enables monitoring of the pressure drop through the gravel pack and enables redundant measures to identify and diagnosis equipment problems. Commands for controlling the position of variable interval control valve 218 and receiving feedback from variable interval control valve 218 are sent via energy conductors in umbilical 220 of upper completion assembly 200. In this manner, fluid production from zone 60 is controlled.

Regarding zone 62, sensors 146 are used to obtain fluid parameter data from exterior and the interior of sand control screen assembly 136. Alternatively or additionally, distributed fluid parameter data may be obtained via one or more of the energy conductors, such as an optic fiber, located in the gravel pack to the exterior of sand control screen assembly 136. In either case, the data is transmitted to a surface processor for reporting and analysis via energy conductor in umbilicals 106 of lower completion assembly 100 and umbilicals 226 of upper completion assembly 200. At the same time, additional fluid parameter data may be obtained by sensors 242 in the annulus between upper completion assembly 100 and lower completion assembly 200 and by sensors 240 to the interior of upper completion assembly 100. This data is transmitted to a surface processor for reporting and analysis via energy conductors in umbilical 220 of upper completion assembly 200. The fluid parameter data associated with production from zone 62 is used to control production from zone 62 by making desired adjustments to the position of infinitely variable interval control valve 244. Commands for controlling the position of variable interval control valve 244 and receiving feedback from variable interval control valve 244 are sent via energy conductors in umbilical 220 of upper completion assembly 200. In this manner, fluid production from zone 62 is controlled.

Regarding zone 64, sensors 166 are used to obtain fluid parameter data from exterior and the interior of sand control screen assembly 156. Alternatively or additionally, distributed fluid parameter data may be obtained via one or more of the energy conductors, such as an optic fiber, located in the gravel pack to the exterior of sand control screen assembly 156. In either case, the data is transmitted to a surface processor for reporting and analysis via energy conductor in umbilicals 106 of lower completion assembly 100 and umbilicals 226 of upper completion assembly 200. At the same time, additional fluid parameter data may be obtained by sensors 258 in the annulus between upper completion assembly 100 and lower completion assembly 200 and by sensors 256 to the interior of upper completion assembly 100. This data is transmitted to a surface processor for reporting and analysis via energy conductors in umbilical 220 of upper completion assembly 200. The fluid parameter data associated with production from zone 64 is used to control production from zone 64 by making desired adjustments to the position of infinitely variable interval control valve 260. Commands for controlling the position of variable interval control valve 260 and receiving feedback from variable interval control valve 260 are sent via energy conductors in umbilical 220 of upper completion assembly 200. In this manner, fluid production from zone 64 is controlled.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for completing a subterranean well, the method comprising:

positioning a lower completion assembly in the well, the lower completion assembly including first and second zonal isolation subassemblies with a lower portion of a first communication medium extending therethrough and coupled to a lower connector;

engaging the lower completion assembly with an upper completion assembly to establish fluid communication between first and second fluid flow control modules of the upper completion assembly, respectively, with the first and second zonal isolation subassemblies, the upper completion assembly including a second communication medium operably associated with the first and second fluid flow control modules and an upper portion of the first communication medium coupled to an upper connector;

operatively connecting the upper and lower connectors to enable communication between the upper and lower portions of the first communication media;

monitoring at least one fluid parameter exterior of the first zonal isolation subassembly via the first communication medium, monitoring the at least one fluid parameter between the first zonal isolation subassembly and the first fluid flow control module via the second communication medium and monitoring the at least one fluid parameter interior of the first fluid flow control module via the second communication medium; and monitoring the at least one fluid parameter exterior of the second zonal isolation subassembly via the first communication medium, monitoring the at least one fluid parameter between the second zonal isolation subassembly and the second fluid flow control module via the second communication medium and monitoring the at least one fluid parameter interior of the second fluid flow control module via the second communication medium.

2. The method as recited in claim 1 further comprising setting a first packer of the upper completion assembly uphole of the lower completion assembly, unlocking an expansion joint of the upper completion assembly uphole of the first packer and setting a second packer of the upper completion assembly uphole of the expansion joint.

3. The method as recited in claim 1 wherein engaging the lower completion assembly with the upper completion assembly further comprises anchoring the upper completion assembly within the lower completion assembly.

4. The method as recited in claim 1 wherein engaging the lower completion assembly with the upper completion assembly further comprises engaging seal assemblies of the upper completion assembly with seal bores of the lower completion assembly to isolate the fluid communication between the first fluid flow control module and the first zonal isolation subassembly and to isolate the fluid communication between the second fluid flow control module and the second zonal isolation subassembly.

5. The method as recited in claim 1 further comprising controlling production through the first zonal isolation subassembly by operating an interval control valve of the first fluid flow control module and controlling production through the second zonal isolation subassembly by operating an interval control valve of the second fluid flow control module.

6. The method as recited in claim 1 further comprising operating the first communication medium as a distributed temperature sensor.

7. A method of operating a completion assembly during production from a subterranean well, the method comprising:

providing an upper completion assembly having first and second fluid flow control modules positioned in a lower completion assembly having first and second zonal isolation subassemblies that are, respectively, in fluid communication with the first and second fluid flow control modules and first and second production zones;

providing a first communication medium having a connection between the upper and lower completion assemblies and extending through the first and second zonal isolation subassemblies;

providing a second communication medium operably associated with the first and second fluid flow control modules;

controlling production from the first production zone by operating the first fluid flow control module responsive to data obtained by monitoring at least one fluid parameter of fluid from the first production zone (1) exterior of the first zonal isolation subassembly, (2) between the first zonal isolation subassembly and the first fluid flow control module and (3) interior of the first fluid flow control module; and controlling production from the second production zone by operating the second fluid flow control module responsive to data obtained by monitoring at least one fluid parameter of fluid from the second production zone (1) exterior of the second zonal isolation subassembly, (2) between the second zonal isolation subassembly and the second fluid flow control module and (3) interior of the second fluid flow control module.

8. The method as recited in claim 7 wherein operating the first fluid flow control module further comprises operating a first valve assembly and wherein operating the second fluid flow control module further comprises operating a second valve assembly.

9. The method as recited in claim 8 wherein operating the first valve assembly further comprises operating a first interval control valve and wherein operating the second valve assembly further comprises operating a second interval control valve.

10. The method as recited in claim 7 wherein monitoring the at least one fluid parameter of fluid from the first production zone exterior of the first zonal isolation subassembly and monitoring the at least one fluid parameter of fluid from the second production zone exterior of the second zonal isolation subassembly occurs via the first communication medium.

11. The method as recited in claim 7 further comprising operating the first communication medium as a distributed temperature sensor.

12. The method as recited in claim 7 wherein monitoring the at least one fluid parameter of fluid from the first production zone between the first zonal isolation subassembly and the first fluid flow control module and monitoring the at least one fluid parameter of fluid from the second production zone between the second zonal isolation subassembly and the second fluid flow control module occurs via the second communication medium.

13. The method as recited in claim 7 wherein monitoring the at least one fluid parameter of fluid from the first production zone interior of the first fluid flow control module and monitoring the at least one fluid parameter of fluid from the second production zone interior of the second fluid flow control module occurs via the second communication medium.

14. A completion assembly for operation in a subterranean well having first and second production zones, the completion assembly comprising:

a lower completion assembly operably positionable in the well, the lower completion assembly including first and second zonal isolation subassemblies;

an upper completion assembly operably positionable at least partially within the lower completion assembly to establish fluid communication between first and second fluid flow control modules of the upper completion assembly, respectively, with the first and second zonal isolation subassemblies;

a first communication medium having a connection between the upper and lower completion assemblies and extending through the first and second zonal isolation subassemblies; and a second communication medium operably associated with the first and second fluid flow control modules, wherein, production from the first production zone is controlled by operating the first fluid flow control module responsive to data obtained by monitoring at least one fluid parameter of fluid from the first production zone (1) exterior of the first zonal isolation subassembly, (2) between the first zonal isolation subassembly and the first fluid flow control module and (3) interior of the first fluid flow control module; and wherein, production from the second production zone is controlled by operating the second fluid flow control module responsive to data obtained by monitoring at least one fluid parameter of fluid from the second production zone (1) exterior of the second zonal isolation subassembly, (2) between the second zonal isolation subassembly and the second fluid flow control module and (3) interior of the second fluid flow control module.

15. The apparatus as recited in claim 14 wherein the first and second zonal isolation subassemblies each include a sand control screen and a production sleeve.

16. The apparatus as recited in claim 14 wherein the first and second fluid flow control modules each include a control assembly and a valve assembly.

17. The apparatus as recited in claim 14 wherein the first communication medium further comprises a distributed temperature sensor.

18. The apparatus as recited in claim 14 wherein the first communication medium carries data obtained from monitoring the at least one fluid parameter of fluid from the first production zone exterior of the first zonal isolation subassembly and data obtained from monitoring the at least one fluid parameter of fluid from the second production zone exterior of the second zonal isolation subassembly.

19. The apparatus as recited in claim 14 wherein the second communication medium carries data obtained from monitoring the at least one fluid parameter of fluid from the first production zone between the first zonal isolation subassembly and the first fluid flow control module and data obtained from monitoring the at least one fluid parameter of fluid from the second production zone between the second zonal isolation subassembly and the second fluid flow control module.

20. The apparatus as recited in claim 14 wherein the second communication medium carries data obtained from monitoring the at least one fluid parameter of fluid from the first production zone interior of the first fluid flow control module and data obtained from monitoring the at least one fluid parameter of fluid from the second production zone interior of the second fluid flow control module.

21. The apparatus as recited in claim 14 wherein the upper completion assembly is retrievable from the lower completion assembly.

22. The apparatus as recited in claim 14 wherein the upper completion assembly is installed within the well in a single trip and wherein the lower completion assembly is installed within the well in a single trip.

* * * * *